US007739850B2

(12) United States Patent
Daudet

(10) Patent No.: US 7,739,850 B2
(45) Date of Patent: Jun. 22, 2010

(54) BUILDING CONSTRUCTION COMPONENTS

(75) Inventor: Larry Randall Daudet, Chesterton, IN (US)

(73) Assignee: Dietrich Industries, Inc., Columbus, OH (US)

( * ) Notice: Subject to any disclaimer, the term of this patent is extended or adjusted under 35 U.S.C. 154(b) by 38 days.

(21) Appl. No.: 11/818,598

(22) Filed: Jun. 15, 2007

(65) Prior Publication Data

US 2008/0028702 A1 Feb. 7, 2008

Related U.S. Application Data

(62) Division of application No. 10/981,868, filed on Nov. 5, 2004, now abandoned.

(51) Int. Cl.
*E06B 3/92* (2006.01)
*E06B 5/00* (2006.01)

(52) U.S. Cl. ..... 52/656.2; 52/656.5; 52/656.4; 52/317; 52/210

(58) Field of Classification Search ..... 52/656.2, 52/656.7, 656.4, 656.5, 204.1, 206, 210, 52/317; 403/205, 231, 191
See application file for complete search history.

(56) References Cited

U.S. PATENT DOCUMENTS

| | | | | |
|---|---|---|---|---|
| 350,570 | A | 10/1886 | Stuart | |
| 1,420,473 | A | 6/1922 | Dawson et al. | |
| 2,090,632 | A | 8/1937 | Kotrbaty | |
| 2,145,407 | A | 1/1939 | Soule | |
| 2,169,254 | A | 8/1939 | Kotrbaty | |
| 2,356,309 | A | 8/1944 | Garbe | |
| 2,741,344 | A | 4/1956 | Herr | |
| 2,869,695 | A | 1/1959 | Herr et al. | |
| 2,981,034 | A | 4/1961 | Burgin | |
| 3,026,977 | A | 3/1962 | Pollock | |
| 3,034,609 | A * | 5/1962 | Young | 52/241 |

(Continued)

FOREIGN PATENT DOCUMENTS

| | | |
|---|---|---|
| CA | 771849 | 11/1967 |

(Continued)

OTHER PUBLICATIONS

Dietrich Industries, Inc., Light Gage Steel Framing Typical Construction Details, 36/90 Dietrich LGSF Details, Oct. 10, 1994, pp. 5-14, Pittsburgh, PA.

(Continued)

*Primary Examiner*—Phi Dieu Tran A
(74) *Attorney, Agent, or Firm*—Fay Sharpe LLP

(57) ABSTRACT

A stud that may be used as a header, as a sill, as a jamb stud, in a support post assembly and as a floor girder. In one embodiment, the stud has a substantially planar web, a first flange and a second flange that each protrude from the web. A first leg protrudes from the first flange such that the first leg is substantially parallel to the substantially planar header web. Likewise, a second leg protrudes from the second flange such that it is substantially parallel to the substantially planar header web. A first return protrudes from the first leg and a second return protrudes from the second leg. Stiffener ribs may be provided in at least one of the web, the first and second flanges and/or the first and second legs.

4 Claims, 15 Drawing Sheets

U.S. PATENT DOCUMENTS

| | | | | | |
|---|---|---|---|---|---|
| 3,035,669 | A | | 5/1962 | Graff | |
| 3,094,197 | A | | 6/1963 | Attwood | |
| 3,103,263 | A | * | 9/1963 | Leeser | 52/213 |
| 3,222,833 | A | | 12/1965 | Woodrum | |
| 3,234,702 | A | | 2/1966 | Zibell | |
| 3,266,209 | A | | 8/1966 | Zibell | |
| 3,287,857 | A | | 11/1966 | Dukas | |
| 3,304,683 | A | | 2/1967 | Ferreira | |
| 3,305,981 | A | | 2/1967 | Biggs et al. | |
| 3,352,074 | A | | 11/1967 | Schwartzberg | |
| 3,369,333 | A | | 2/1968 | Wheeler | |
| 3,436,886 | A | * | 4/1969 | Nowak et al. | 52/208 |
| 3,461,638 | A | | 8/1969 | Balinski | |
| 3,469,360 | A | | 9/1969 | Peterson et al. | |
| 3,482,369 | A | | 12/1969 | Burke | |
| 3,483,665 | A | | 12/1969 | Miller | |
| 3,485,001 | A | | 12/1969 | Miller | |
| 3,570,203 | A | | 3/1971 | Williams | |
| 3,599,386 | A | | 8/1971 | LaLonde | |
| 3,612,291 | A | | 10/1971 | Skubic | |
| 3,653,172 | A | | 4/1972 | Schwartz | |
| 3,685,230 | A | * | 8/1972 | Lickliter et al. | 52/677 |
| 3,685,866 | A | * | 8/1972 | Patenaude | 403/189 |
| 3,721,055 | A | | 3/1973 | Jerchower | |
| 3,769,773 | A | * | 11/1973 | Mochizuki | 52/656.4 |
| 3,907,445 | A | | 9/1975 | Wendt | |
| 3,948,011 | A | | 4/1976 | Price et al. | |
| 4,005,941 | A | | 2/1977 | Laborde | |
| 4,007,570 | A | * | 2/1977 | Hunter | 52/317 |
| 4,010,582 | A | | 3/1977 | Burgin | |
| 4,018,020 | A | | 4/1977 | Sauer et al. | |
| 4,038,799 | A | | 8/1977 | Shanks | |
| 4,075,810 | A | | 2/1978 | Zakrzewski et al. | |
| 4,109,438 | A | * | 8/1978 | De la Concha | 52/630 |
| 4,128,979 | A | | 12/1978 | Price | |
| 4,193,245 | A | | 3/1980 | Johnson | |
| 4,235,054 | A | | 11/1980 | Cable et al. | |
| 4,490,958 | A | | 1/1985 | Lowe | |
| 4,513,555 | A | | 4/1985 | Johnson | |
| 4,616,453 | A | | 10/1986 | Sheppard, Jr. et al. | |
| 4,619,098 | A | | 10/1986 | Taylor | |
| 4,638,615 | A | | 1/1987 | Taylor | |
| 4,693,047 | A | | 9/1987 | Menchetti | |
| 4,809,476 | A | | 3/1989 | Satchell | |
| 4,870,794 | A | | 10/1989 | Menchetti | |
| 4,881,346 | A | | 11/1989 | Block | |
| 4,909,005 | A | | 3/1990 | Adams | |
| 4,914,878 | A | | 4/1990 | Tamaki et al. | |
| 4,918,899 | A | | 4/1990 | Karytinos | |
| 5,010,709 | A | | 4/1991 | Paz | |
| 5,127,760 | A | | 7/1992 | Brady | |
| 5,155,962 | A | | 10/1992 | Burkstrand et al. | |
| 5,157,883 | A | | 10/1992 | Meyer | |
| 5,189,857 | A | | 3/1993 | Herren et al. | |
| 5,222,335 | A | | 6/1993 | Petrecca | |
| 5,230,132 | A | * | 7/1993 | Chou | 29/402.08 |
| 5,287,675 | A | | 2/1994 | McGee | |
| 5,325,651 | A | | 7/1994 | Meyer et al. | |
| 5,380,116 | A | | 1/1995 | Colonias | |
| 5,394,665 | A | | 3/1995 | Johnson | |
| 5,425,212 | A | | 6/1995 | Menchetti | |
| 5,483,773 | A | | 1/1996 | Parisien | |
| 5,515,660 | A | | 5/1996 | Hanks et al. | |
| 5,592,796 | A | | 1/1997 | Landers | |
| 5,593,115 | A | * | 1/1997 | Lewis | 248/68.1 |
| 5,605,024 | A | | 2/1997 | Sucato et al. | |
| 5,671,580 | A | | 9/1997 | Chou | |
| 5,687,538 | A | * | 11/1997 | Frobosilo et al. | 52/846 |
| 5,689,922 | A | | 11/1997 | Daudet | |
| 5,713,176 | A | | 2/1998 | Hunt | |
| 5,720,138 | A | | 2/1998 | Johnson | |
| 5,771,653 | A | | 6/1998 | Dolati et al. | |
| 5,797,233 | A | | 8/1998 | Hascall | |
| 5,797,694 | A | | 8/1998 | Breivik | |
| 5,802,782 | A | | 9/1998 | Jewell | |
| 5,803,653 | A | | 9/1998 | Zuffetti | |
| 5,950,385 | A | | 9/1999 | Herren | |
| 6,088,988 | A | | 7/2000 | Sahramaa | |
| 6,164,028 | A | | 12/2000 | Hughes | |
| 6,176,053 | B1 | | 1/2001 | St. Germain | |
| 6,189,277 | B1 | | 2/2001 | Boscamp | |
| 6,260,318 | B1 | | 7/2001 | Herren | |
| 6,282,862 | B1 | | 9/2001 | Weeks | |
| 6,290,214 | B1 | | 9/2001 | DeSouza | |
| 6,301,854 | B1 | | 10/2001 | Daudet et al. | |
| 6,363,682 | B1 | | 4/2002 | Cowley | |
| 6,560,938 | B1 | | 5/2003 | Powers, Jr. | |
| 6,609,344 | B2 | | 8/2003 | Saldana | |
| 6,698,146 | B2 | | 3/2004 | Morgan et al. | |
| 6,701,689 | B2 | | 3/2004 | diGirolamo | |
| 6,739,105 | B2 | * | 5/2004 | Fleming | 52/513 |
| 6,754,999 | B1 | | 6/2004 | Urbanczyk | |
| 6,783,345 | B2 | | 8/2004 | Morgan et al. | |
| 7,065,932 | B2 | | 6/2006 | Roesset et al. | |
| 2002/0043040 | A1 | | 4/2002 | Cherry et al. | |
| 2002/0139079 | A1 | | 10/2002 | Brady | |
| 2003/0145537 | A1 | | 8/2003 | Bailey | |
| 2003/0163970 | A1 | | 9/2003 | Moore et al. | |
| 2003/0167722 | A1 | | 9/2003 | Klein et al. | |
| 2003/0196401 | A1 | | 10/2003 | Surowiecki | |
| 2004/0083665 | A1 | | 5/2004 | Surowiecki | |
| 2005/0126105 | A1 | | 6/2005 | Leek et al. | |
| 2005/0284073 | A1 | | 12/2005 | Leek et al. | |
| 2006/0096192 | A1 | | 5/2006 | Daudet | |
| 2006/0096200 | A1 | | 5/2006 | Daudet | |
| 2006/0096201 | A1 | | 5/2006 | Daudet | |

FOREIGN PATENT DOCUMENTS

| | | | | |
|---|---|---|---|---|
| CA | 1 207 192 | | 7/1986 | |
| CA | 2538593 | | 9/2006 | |
| CA | 2538649 | | 9/2006 | |
| JP | 2004324384 | * | 11/2004 | 52/236.3 |

OTHER PUBLICATIONS

The Steel Network, Inc., Load Bearing Wall Systems, Jun. 2004, Raleigh, NC—48 pages.

Grace Construction Products, We've Invented a New Way to Firestop Head-of-Wall Joints, 2004—2 pages.

Restriction Requirement mailed on Apr. 2, 2007 in U.S. Appl. No. 10/981,868.

Response to Restriction Requirement filed May 8, 2007 in U.S. Appl. No. 10/981,868.

Non-Final Office Action mailed on Aug. 15, 2007 in U.S. Appl. No. 10/981,868.

Amendment filed Sep. 5, 2007 in U.S. Appl. No. 10/981,868.

Final Office Action mailed Nov. 28, 2007 in U.S. Appl. No. 10/981,868.

Amendment filed May 28, 2008 in U.S. Appl. No. 10/981,868.

Non-Final Office Action mailed on Jul. 21, 2008 in U.S. Appl. No. 10/981,868.

Restriction Requirement mailed on Sep. 26, 2007 in U.S. Appl. No. 11/093,804.

Response to Restriction Requirement filed Oct. 24, 2007 in U.S. Appl. No. 11/093,804.

Non-final Office Action mailed on Jan. 10, 2008 in U.S. Appl. No. 11/093,804.

Restriction Requirement mailed on Jan. 28, 2008 in U.S. Appl. No. 11/139,183.

The Steel Network, Inc., Curtain Wall Systems, Mar. 2005, Raleigh, NC—20 pages.

Dietrich Industries, Inc., Light Gauge Steel Framing Typical Construction Details, 36/90 Dietrich LGSF Details, Oct. 10, 1994, pp. 5-14, Pittsburgh, PA.

The Steel Network, Inc., Load Bearing Wall Systems, Jun. 2004, Raleigh, NC—49 pages.
Grace Construction Products, We've Invented a New Way to Firestop Head-of-Wall Joints, 2004—2 pages.
Superior Specialty Supply Catalog, pp. 19-24 (http:/web.archive.org/web/20030519213143/http://www.ssupply.com/Catalog/Deflection_Clips_Angles.pdf).
The Steel Network (http://web.archive.org/web/20040508074638/http://www.steelnetwork.com/), 2 pages.
MarinoWare. Oct. 2003. Joist-Rite Catalog, 8 pages.
Simpson Strong Tie 2003 Catalog, p. 146.

* cited by examiner

BUILDING CONSTRUCTION COMPONENTS

CROSS REFERENCE TO RELATED APPLICATIONS

This application is a divisional patent application of U.S. patent application Ser. No. 10/981,868, filed Nov. 5, 2004 now abandoned, entitled "BUILDING CONSTRUCTION COMPONENTS", the disclosure of which is herein incorporated in its entirety.

BACKGROUND OF THE INVENTION

1. Field of the Invention

The invention relates to building construction components and, more particularly, to building construction components fabricated from metal such as headers, sills, trusses, girders and support posts.

2. Description of the Invention Background

Traditionally, the material of choice for new residential and commercial building framing construction has been wood. However, over the years, the rising costs of lumber and labor required to install wood framing components have placed the dream of owning a newly constructed home out of the economic reach of many families. Likewise, such increasing costs have contributed to the slowing of the development and advancement of urban renewal plans in many cities. Other problems such as the susceptibility to fire and insect damage, rotting, etc. are commonly associated with wood building products.

In view of the foregoing problems and shortcomings of wood construction, steel is rapidly gaining acceptance among homebuilders and homeowners alike due to its cost effectiveness, dimensional stability, noncombustibility, insect resistance, durability, high strength-to-weight ratio and recycleability. These advantages have long been recognized by the commercial construction industry wherein steel has been the material of choice for several decades.

Regardless of whether a building comprises a multistory commercial structure or a single story residence, C-shaped metal studs and tracks are commonly used in their construction. FIG. 1 illustrates a conventional C-shaped metal stud 10 that has a web 12 and a pair of flanges 14. A lip 16 is also formed on the end of each flange 14 to further strengthen the stud. Such studs 10 are commonly fabricated from cold-formed steel utilizing conventional rollforming techniques. Similarly, the conventional tracks 20 that are employed by the building trades each have a web 22 and a pair of flanges 24. The tracks 20 are similar in construction as the C-shaped studs, but lack the lack the lips that are commonly formed on the ends of the stud flanges. See FIG. 2.

In most construction applications, walls are constructed by attaching a series of C-shaped studs between a top track and a bottom track. The bottom track is usually attached to the floor structure by screws or other fasteners and the top track is usually attached to the ceiling joists. The ends of the studs are inserted into the top and bottom tracks and are attached thereto by screws, welds, etc. After the wall frame is constructed, then the desired wallboard material is attached to the flanges of the studs and tracks utilizing screws or other fasteners to complete the wall assembly.

In those walls that require door and/or window openings to be framed therein, a header is constructed to transfer loads occurring above the opening to the vertically extending studs adjacent the opening. The studs that define the vertical boundaries of the opening are often referred to as the "jamb" studs. FIGS. 3-5 illustrate one prior header and jamb stud arrangement that is formed utilizing conventional C-shaped studs and tracks. As can be seen in FIGS. 3 and 4, the header 30 is formed by attaching a first C-shaped stud 32 to a track 40 such that the flanges 36 of the stud 32 are received between the flanges 42 of the track 40. A second upwardly facing piece of track 46 is then attached to the web 34 of the first stud 32. Such header 30 is commonly fabricated by attaching these components together with fasteners such as screws 49 or the like. The use of such screws, however, creates undesirable buildups which can lead to drywall finishing problems. In the alternative, the components may be welded together which adds to assembly time and expense.

Likewise, the jamb studs 50 are each commonly formed by attaching a C-shaped stud 52 to another piece of track 60 such that the flanges 56 of the stud 52 are received between the flanges 64 of the track 60 and then attaching the web 72 of another stud 70 to the web 64 of the track 60. These components are also commonly coupled together with screws 49 which can lead to drywall finishing problems. In the alternative, they may be welded together to form the jamb stud 50. Such assembly approach requires additional skilled labor. These combinations of components have been found to provide the jamb stud with a sufficient amount of strength to receive the loads from the header without failing or buckling.

To complete the header assembly, the header 30 is then attached to each jamb stud 50 by corresponding L-shaped clips 80. The clips 80 are welded or screwed to each jamb stud 50. In addition, sections of studs 82 are attached between the track 60 and the section of upper track (not shown) to which the upper ends of the jamb studs 50 are attached. Such stud segments 82 are often referred to in the industry as "cripple studs" and further transfer loads from the upper structures to the header.

FIG. 6 illustrates a prior truss chord 90 that is fabricated utilizing conventional C-shaped studs. By way of background, trusses are used to form the support frame for a roof or, in some applications, are used to form the support for an upper floor. The upper and lower portions of the truss are known as the "chords" and the members that extend between the chords are called "webs". As can be seen in FIG. 6, a typical method employed to form a truss chord 90 is to weld two C-shaped studs 92 together as shown. The truss webs are formed from other pieces of C-shaped studs 94 that are fastened to the chord 90 by screws, bolts etc. This arrangement, however, is labor intensive because studs have to be welded together to form the necessary chords.

Conventional C-shaped studs and tracks are also used to form support posts for supporting loads from the structures located above the posts. FIG. 7 illustrates a prior method of constructing a support post. As can be seen in that Figure, a total of 3 C-shaped studs 102 and two tracks 104 are employed. The studs 102 and tracks 104 may be connected together by a collection of screws or by welding. Both fastening methods, however, are time consuming and attribute to higher labor costs associated with their fabrication.

Floors are also constructed utilizing components that are somewhat identical to C-shaped studs and tracks utilized to form the wall frames for the structure. However, the tracks and C-shaped members used to form the floor structure can be larger than those like-shaped components used to form wall structures. The floor of a structure is commonly formed from a series of C-shaped members that span the distance between support structures or support walls. These C-shaped members are commonly referred to as floor joists. The ends of the joists are coupled to tracks referred to as joist rims that are either supported on a wall or other structure by one of their flanges or have their webs attached to the wall or structure. The joists are commonly attached to the joist rims by conventional L-shaped clips or by tabs that are integrally formed in the web of the joist rim.

In those instances wherein the span is too long or loading conditions require it, beams known as girders are employed. The girders serve as points of attachments for the ends of adjacent floor joists as shown in FIG. 8. In the past, many floor girders 110 were fabricated utilizing a conventional stud 112 nested in a conventional track 118. The flanges of the track 118 and stud 112 were attached together utilizing screws 119 or welds. The floor joists 120 were then attached to the girder 110 by means of L-shaped clips 122 and screws. Such approach required extra labor to assembly the girders. In addition, when screws are used to assemble the girder, the screws cause the flooring material to be raised up or bulge in the area around each screw head.

Thus, as can be appreciated from the forgoing discussion, a variety of different components utilized in constructing residential and commercial buildings from steel are fabricated from conventional C-shaped studs and tracks. While the use of such components affords a host of advantages over the use of wood beams and the like, the added labor and materials required to fabricate such components undesirably lead to increased construction costs.

SUMMARY

In accordance with one embodiment of the present invention, there is provided a header assembly that includes a first vertically extending jamb stud and a second vertically extending jamb stud supported in spaced apart relationship. A first connector is attached to the first vertically extending jamb stud. The first connector has a pair of spaced legs that define a first header-receiving area therebetween. A second connector is attached to the second vertically extending jamb stud and has a pair of spaced legs that define a second header-receiving area therebetween. The header assembly also comprises a single-piece, integral header that has a first end that is received in the first header-receiving area of the first connector and a second end that is received in the second header-receiving area of the second connector. The header also spans between the first and second vertically extending jamb studs to define an opening therebetween. In one embodiment, the header comprises a substantially planar header web that has a first header flange and a second header flange protruding therefrom. A first header leg protrudes from the first header flange and is substantially parallel to the substantially planar header web. A second header leg protrudes from the second header flange and is substantially parallel to the substantially planar header web and is substantially coplanar with the first header leg to define support surfaces spanning between the first and second upwardly extending jamb studs. A first header return is formed on an end of the first header leg and a second header return is formed on an end of the second header leg.

Another embodiment of the present invention comprises a wall structure that includes a bottom track, a top track and a plurality of vertically extending studs that extend between the top and bottom tracks and are attached thereto. A first jamb stud extends between the top and bottom tracks and is attached thereto. A second jamb stud also extends between the top and bottom tracks and is attached thereto such that it is spaced from the first jamb stud. A first connector that has a pair of spaced legs that define a first header-receiving area therebetween is attached to the first jamb stud. A second connector that has a pair of spaced legs that define a second header-receiving area therebetween is attached to the second jamb stud. The wall structure of this embodiment further includes a single-piece, integral header that has a first end received in the first header-receiving area of the first connector and a second end that is received in the second header-receiving area of the second connector. The header also spans between the first and second vertically extending jamb studs to define an opening therebetween. In one embodiment, the header comprises a substantially planar header web, a first header flange that protrudes from the substantially planar header web and a second header flange that protrudes from the substantially planar header web. The second header flange is spaced from the upwardly extending first header flange. A first header leg protrudes from the first header flange and is substantially parallel to the substantially planar header web. A second header leg protrudes from the second header flange and is substantially parallel to the substantially planar header web and is substantially coplanar with the first header leg to define support surfaces spanning between the first and second jamb studs. A first header return is formed on an end of the first header leg and a second header return is formed on an end of the second header leg.

Another embodiment of the subject invention comprises a header assembly that includes a first vertically extending jamb stud and a second vertically extending jamb stud that is supported in spaced apart relationship with respect to the first vertically extending jamb stud. A first connector is attached to the first vertically extending jamb stud. The first connector has a raised first central portion with first return-receiving grooves therein. Likewise, a second connector is attached to the second vertically extending jamb stud. The second connector has a raised first central portion with second return-receiving grooves therein. The header assembly of this embodiment further comprises a single-piece, integral header that has a substantially planar header web, a first header flange that protrudes from the substantially planar header web and a second header flange that protrudes from the substantially planar header web and is spaced from the first header flange. A first header leg protrudes from the first header flange and is substantially parallel to the substantially planar header web. A second header leg protrudes from the second header flange and is substantially parallel to the substantially planar header web and is substantially coplanar with the first header leg to define support surfaces spanning between the first and second vertically extending jamb studs. The first header web and the first and second header flanges and legs defining a hollow area within the header. A first header return is formed on an end of the first header leg and a second header return is formed on an end of the second header leg. The header is supported between the first and second jamb studs such that the first raised central portion of the first connector is received in the hollow area within one end of the header such that the first and second header returns are received in the first return-receiving grooves in the first raised central portion. The second raised central portion of the second connector is received in the hollow area adjacent another end of the header such that the first and second returns are received in the second return-receiving grooves in the second raised central portion.

Yet another embodiment of the present invention comprises a wall structure that includes a bottom track, a top track and a plurality of vertically extending studs that extend between the top and bottom tracks and are attached thereto. A first jamb stud extends between the top and bottom tracks and is also attached thereto. Likewise, a second jamb stud extends between the top and bottom tracks and is attached thereto such that the second jamb stud spaced from the first jamb stud. A first connector having a raised first central portion with first return-receiving grooves therein is attached to the first jamb stud. A second connector having a second raised central portion with second return-receiving grooves therein is attached to the second jamb stud. The wall structure of this embodiment further includes a single-piece, integral header that has a substantially planar header web, a first header flange that protrudes from the substantially planar header web and a second header flange that protrudes from the substantially planar header web and is spaced from the first header flange. A first header leg protrudes from the first header flange and is substantially parallel to the substantially planar header web. A second header leg protrudes from the second header flange and is substantially parallel to the substantially planar header web and is substantially coplanar with the first header leg to define support surfaces spanning between the first and second vertically extending jamb studs. The first header web and the first and second header flanges and legs defining a hollow area within the header. A first header return is formed on an end of the first header leg and a second header return is formed on an end of the second header leg. The header is supported between the first and second jamb studs such that the first raised central portion of the first connector is received in the hollow area within one end of the header such that the first and second header returns are received in the first return-receiving grooves in the first raised central portion. The second raised central portion of the second connector is received in the hollow area adjacent another end of the header such that the first and second returns are received in the second return-receiving grooves in the second raised central portion.

Still another embodiment of the present invention comprises a truss assembly that includes a chord stud that has a chord web, a first chord flange that protrudes from the chord web and a second chord flange that protrudes from the chord web and is spaced from the first chord flange. A first chord leg protrudes from the first chord flange and is substantially parallel to the chord web. A second chord leg protrudes from the second chord flange and is substantially parallel to the chord web and is substantially coplanar with the first chord leg. A first chord return is formed on an end of the first chord leg and a second chord return is formed on an end of the second chord leg. A plurality of truss webs are attached to the chord stud.

Another embodiment of the present invention comprises a support post that includes a post stud that comprises a substantially planar post web, a first post flange that protrudes from the substantially planar post web and a second post flange that protrudes from the substantially planar post web and is spaced from the first post flange. A first post leg protrudes from the first post flange and is substantially parallel to the substantially planar post web. A second post leg protrudes from the second post flange and is substantially parallel to the substantially planar post web and substantially coplanar with the first post leg. A first post return is formed on an end of the first post leg and a second post return is formed on an end of the second post leg. First and second studs are fastened to the post stud.

Another embodiment of the present invention comprises a floor system that includes a floor girder which includes a substantially planar girder web, a first girder flange that protrudes from the substantially planar girder web and a second girder flange that protrudes from the substantially planar girder web and is spaced from the first girder flange. A first girder leg protrudes from the first girder flange and is substantially parallel to the substantially planar girder web. A second girder leg protrudes from the second girder flange and is substantially parallel to the substantially planar girder web and is substantially coplanar with the first girder leg. A first girder return is formed on an end of the first girder leg and a second girder return is formed on an end of the second girder leg. At least one first joist and at least one second joist are fastened to the girder.

Another embodiment of the present invention comprises a single-piece, integral header stud. In one embodiment, the header stud includes a substantially planar header web and first and second header flanges that protrude from the substantially planar header web. A first header leg protrudes from the first header flange and is substantially parallel to the substantially planar header web. A second header leg protrudes from the second header flange and is substantially parallel to the substantially planar header web and is substantially coplanar with the first header leg. A first header return is formed on an end of the first header leg and a second header return is on an end of the second header leg. At least one stiffener rib is formed in at least one of the planar header web, the first header flange, the second header flange, the first header leg and the second header leg.

Another embodiment of the present invention comprises a sill assembly that includes a first vertically extending jamb stud and a second vertically extending jamb stud that is supported in spaced apart relationship with respect to the first vertically extending jamb stud. A first C-shaped connector attached to the first vertically extending jamb stud and has a pair of spaced first flanges that define a first sill-receiving area therebetween. A second C-shaped connector is attached to the second vertically extending jamb stud and has a pair of spaced second flanges that define a second sill-receiving area therebetween. The sill assembly further includes a single-piece, integral sill stud that has a first end received in the first sill-receiving area of the first C-shaped connector and a second end received in the second sill-receiving area of the second C-shaped connector. The sill stud spans between the first and second vertically extending jamb studs and in one embodiment comprises substantially planar sill stud web and a first sill stud flange that protrudes from the substantially planar sill stud web and a second sill stud flange that protrudes from the substantially planar sill stud web and is spaced from the first sill stud flange. A first sill stud leg protrudes from the first sill stud flange and is substantially parallel to the substantially planar sill stud web. A second sill stud leg protrudes from the second sill stud flange and is substantially parallel to the substantially planar sill stud web and is further substantially coplanar with the first sill stud leg. A first sill stud return is formed on an end of the first sill stud leg and a second sill stud return is formed on an end of the second sill stud leg.

BRIEF DESCRIPTION OF THE DRAWINGS

In the accompanying Figures, there are shown present embodiments of the invention wherein like reference numerals are employed to designate like parts and wherein:

FIG. 11 A is a perspective view of the header and jamb stud embodiment depicted in FIG. 11 with a conventional stud attached to the jamb stud;

DETAILED DESCRIPTION OF THE INVENTION

Figure 1:
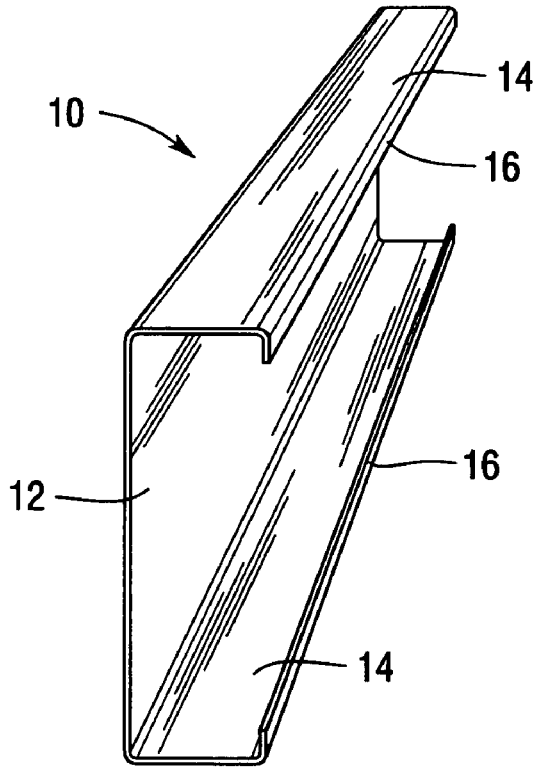
Prior Art Fig.1
FIG. 1 is a perspective view of a prior art C-shaped stud.
Figure 2:
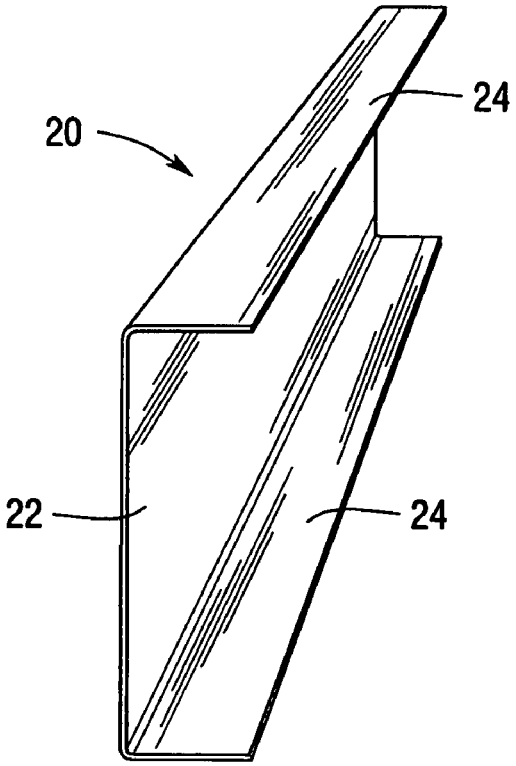
Prior Art Fig.2
FIG. 2 is a perspective view of a prior art track.
Figure 3:
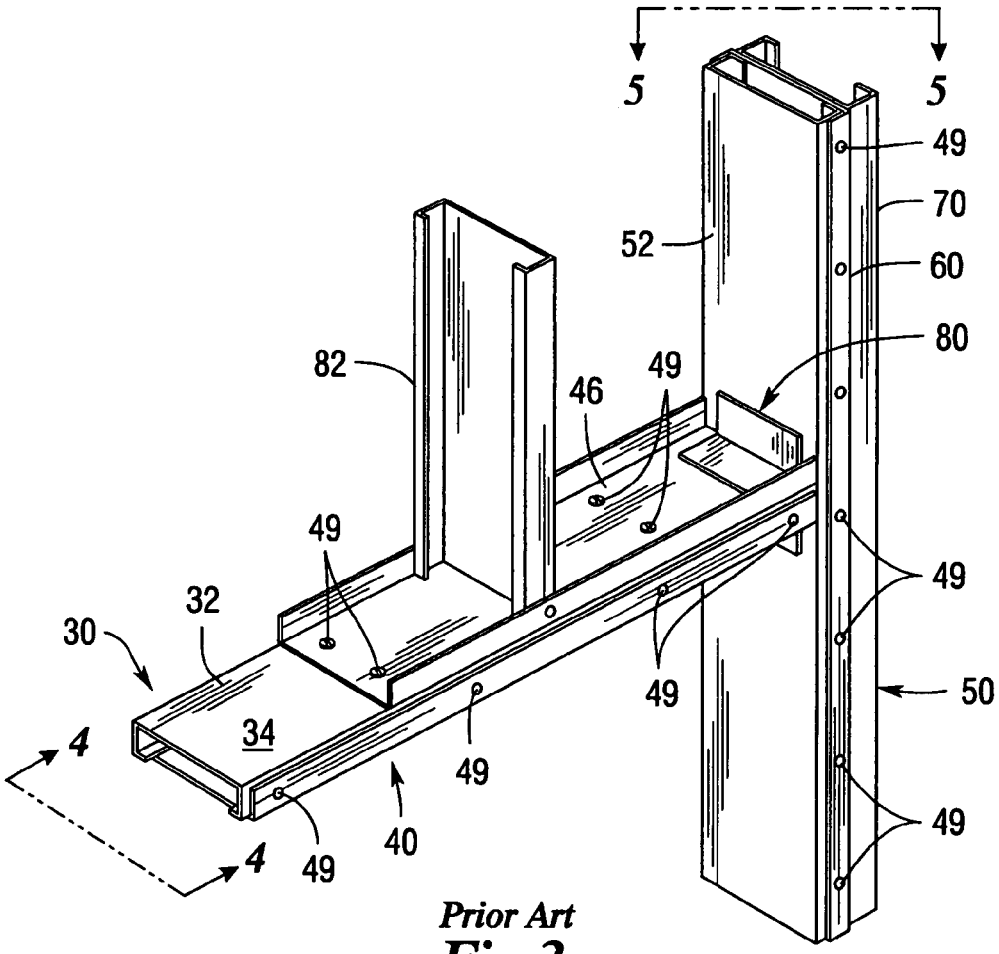
Prior Art Fig.3
FIG. 3 is a partial perspective view of a prior header and jamb stud arrangement.
Figure 4:
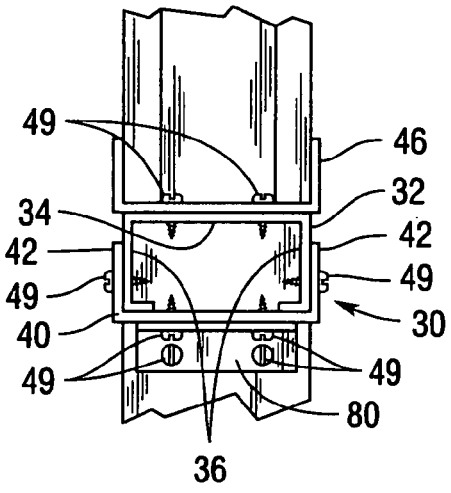
Prior Art Fig.4
FIG. 4 is a partial end view of the prior header arrangement depicted in FIG. 3.
Figure 5:
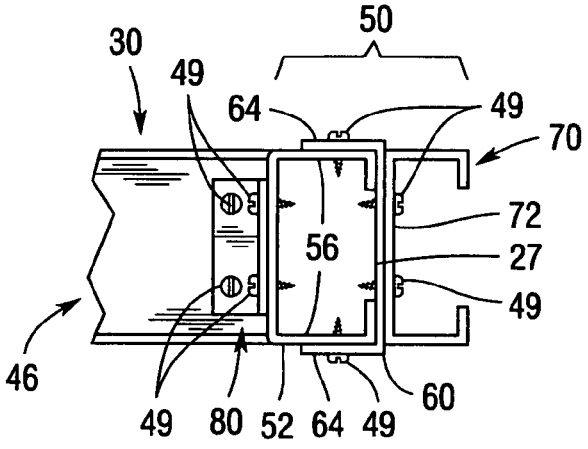
Prior Art Fig.5
FIG. 5 is a partial end of the prior jamb stud arrangement depicted in FIG. 3.
Figure 6:
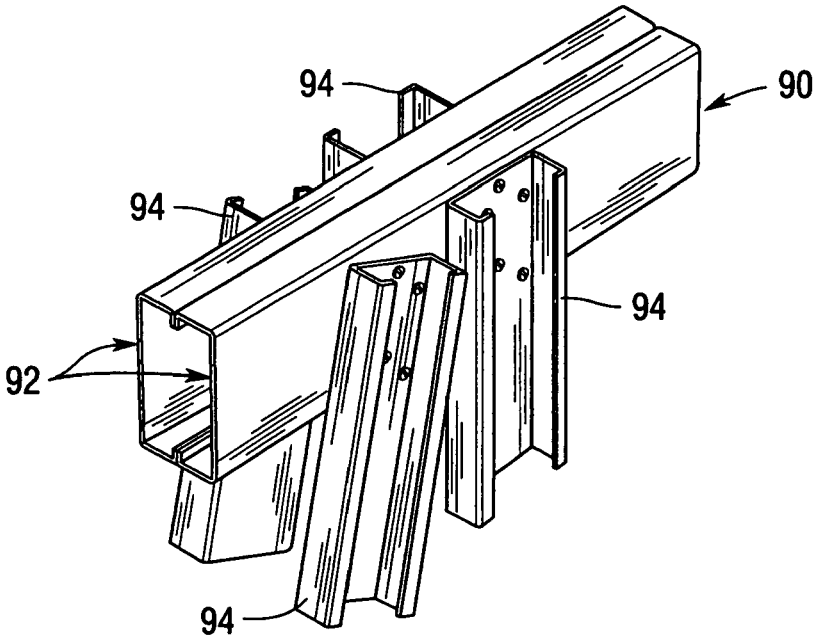
Prior Art Fig.6
FIG. 6 is a partial perspective view of a prior truss chord assembly.
Figure 7:
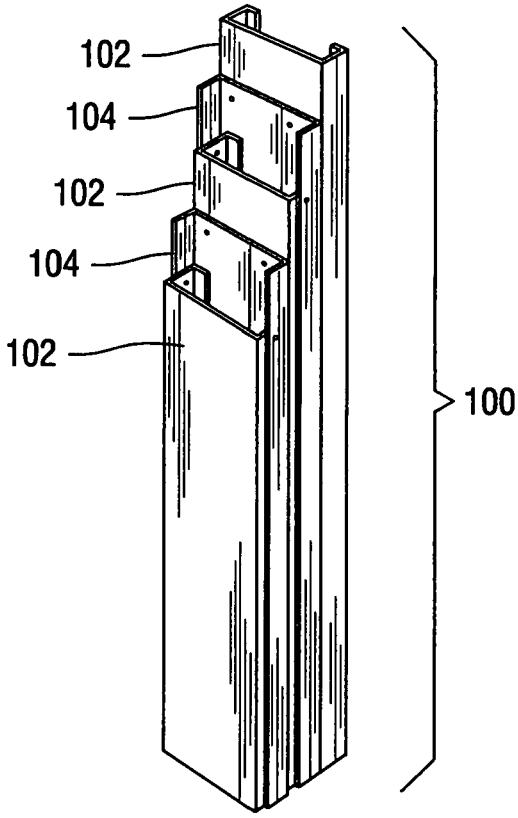
Prior Art Fig.7
FIG. 7 is a partial perspective view of a prior art post arrangement.
Figure 8:
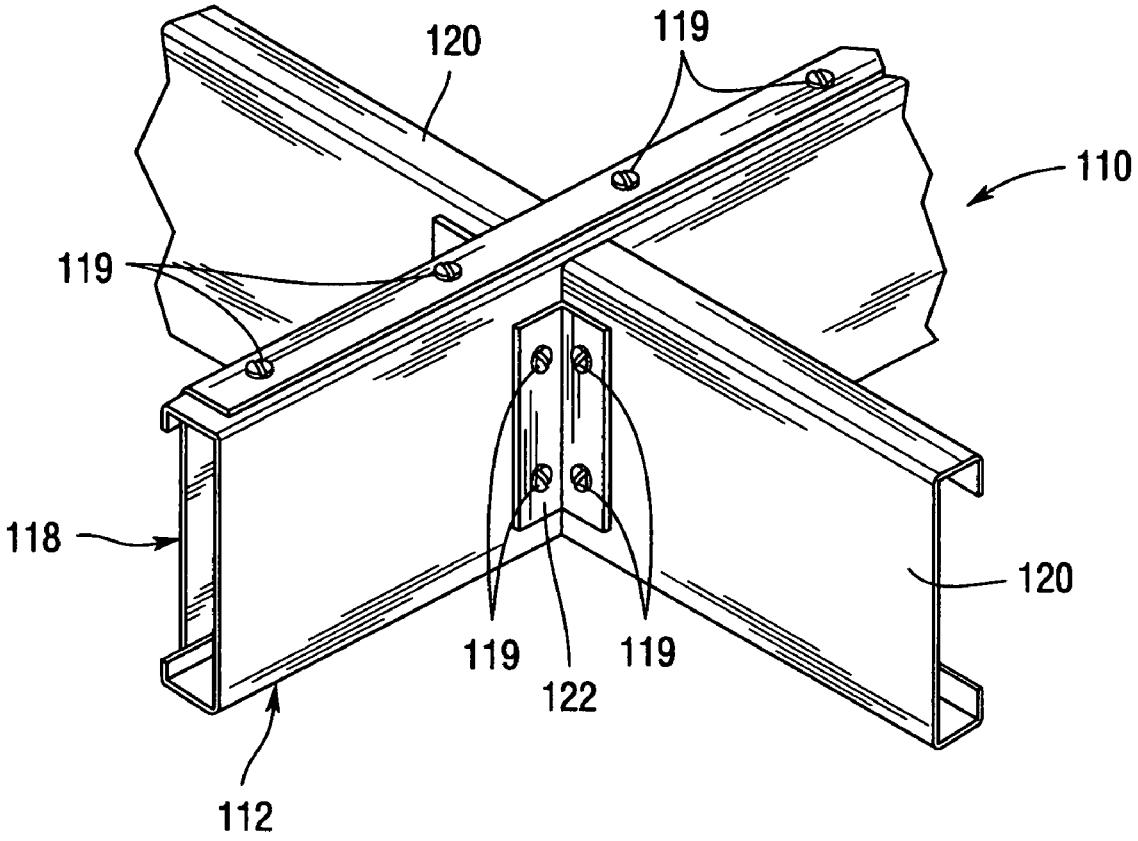
Prior Art Fig.8
FIG. 8 is a partial perspective view of a prior floor girder and floor joist arrangement.
Figure 9:
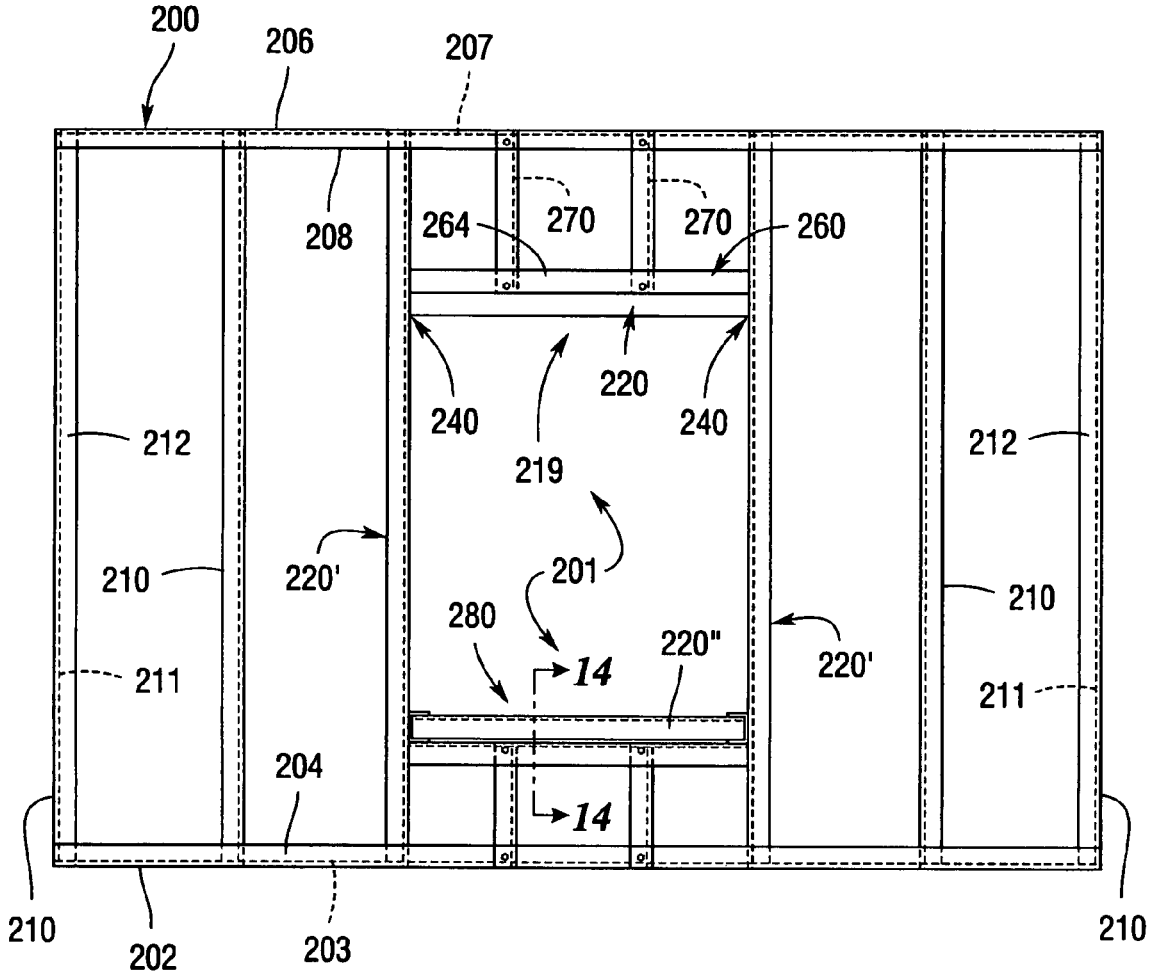
FIG. 9 is an elevational view of a wall frame that employs a header embodiment, a sill embodiment and a jamb stud embodiment of the present invention.
Figure 11:
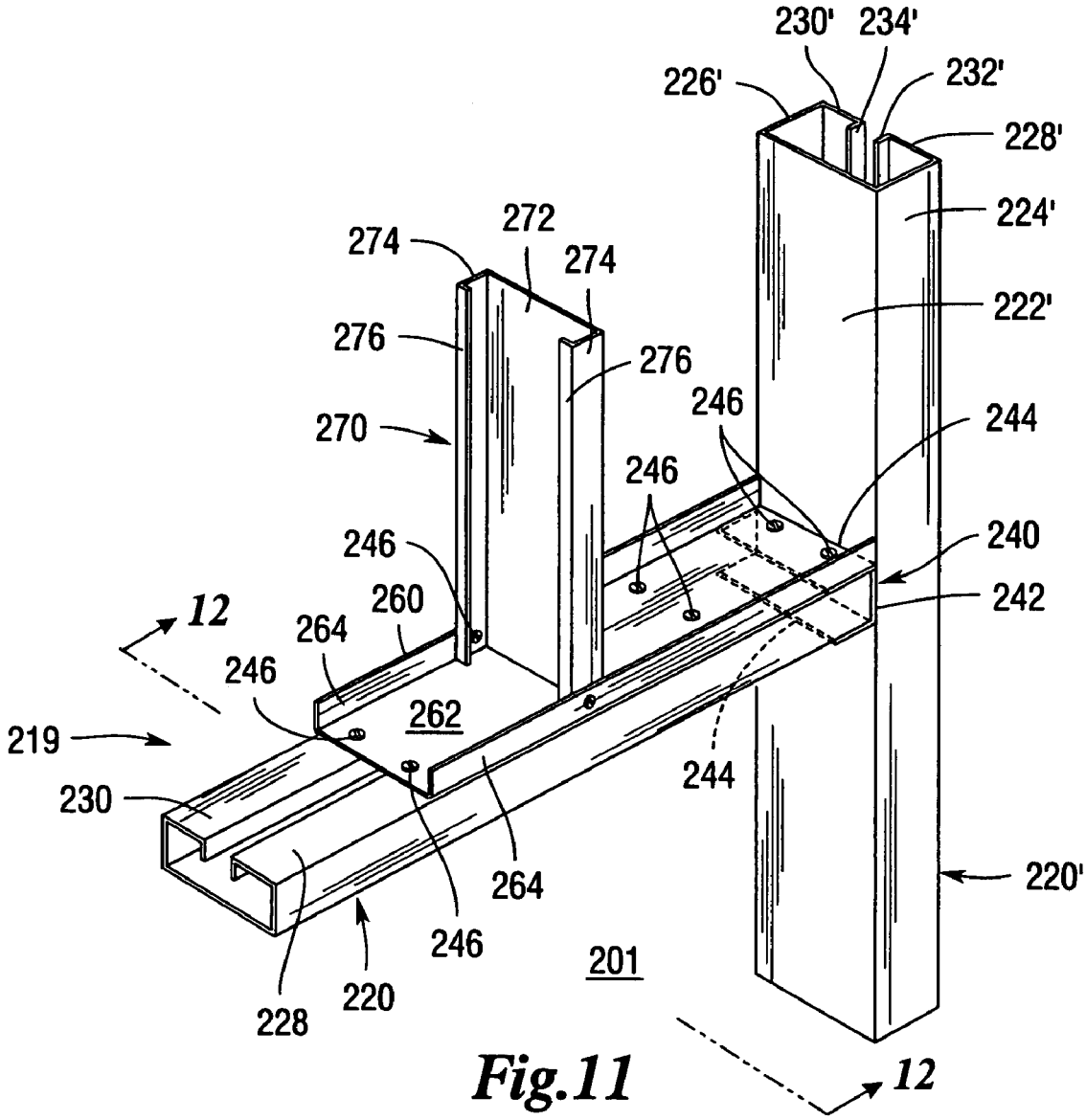
FIG. 11 is a perspective view of a portion of a header and jamb stud embodiment of the present invention.
Figure 12:
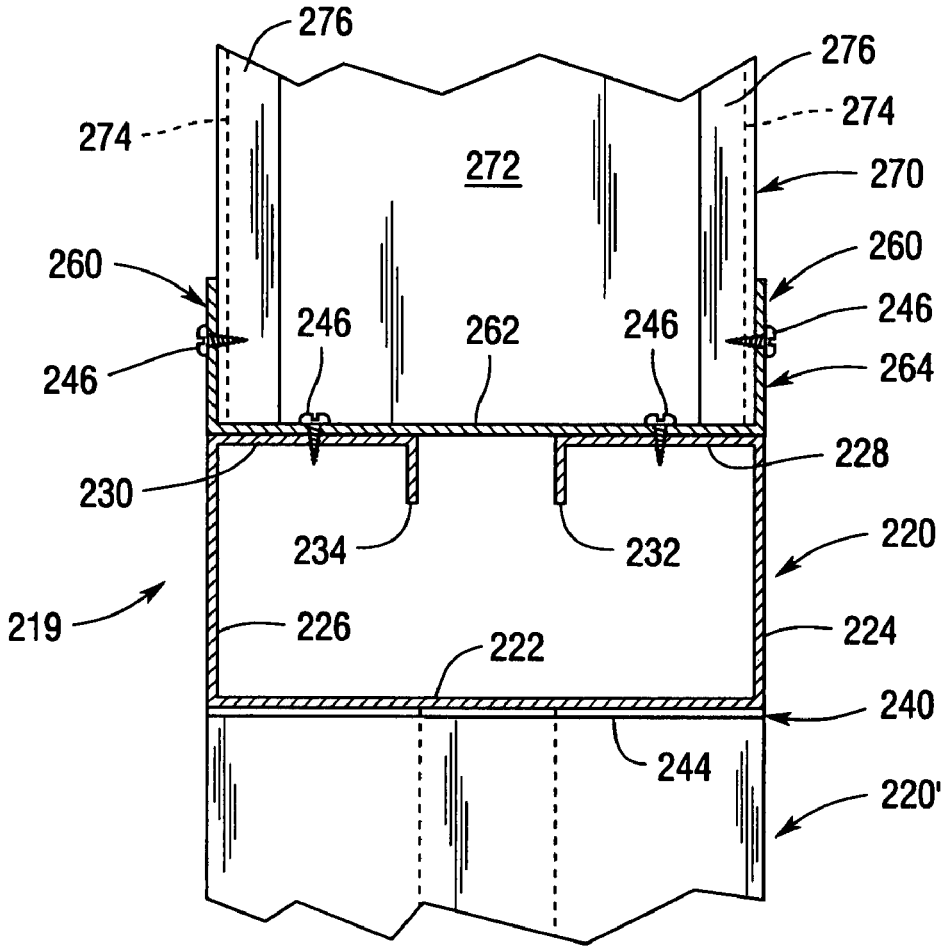
FIG. 12 is a partial cross-section view of the header and jamb stud embodiment of the FIG. 11 taken along line 12-12 in FIG. 11.

Referring now to the drawings for the purposes of illustrating the present embodiments of the invention only and not for the purposes of limiting the same, FIGS. 9, 11 and 12 illustrate one embodiment of a header assembly 219 of the present invention utilized to form a window opening 201 in a wall frame structure 200. As can be seen in FIG. 9, the wall frame structure 200 may be fabricated from a lower track 202 and an upper track 206. The lower track has a web 203 and a pair of upstanding flanges 204. Similarly, the upper track 206 has a web 207 and a pair of flanges 208. A plurality of studs 210 are connected between the lower track 202 and the upper track 206 utilizing screws or other suitable fastening methods. The studs 210 are conventional in nature and have a web 211, a pair of flanges 212 and a lip formed on the end of each flange 212.

Figure 10:
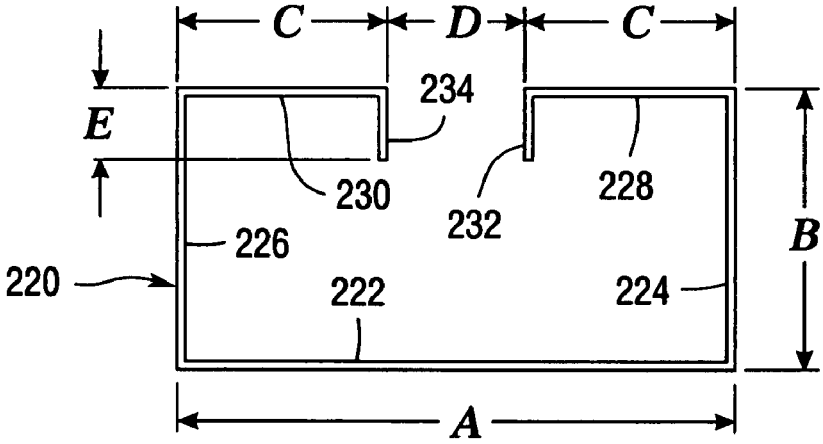
FIG. 10 is an end view of a stud embodiment of the present invention.

In this embodiment, the header assembly 219 is formed from a uniquely shaped header stud 220, one embodiment of which is depicted in FIG. 10. As can be seen in FIG. 10, stud 220 includes a substantially planar header web 222, a first header flange 224 and a second header flange 226. The first and second header flanges (224, 226) protrude outwardly from the substantially planar header web 222. A first header leg 228 protrudes from the first header flange 224 such that the first header leg 228 is substantially parallel to the substantially planar header web 222. Likewise, a second header leg 230 protrudes from the second header flange 226 such that it is substantially parallel to the substantially planar header web 222. A first header return 232 protrudes from the first header leg 228 and a second header return 234 protrudes from the second header leg 230.

In one embodiment, the stud 220 is rollformed from steel sheet by utilizing conventional rollforming methods and equipment. For example, the stud 220 may be fabricated from 12, 14, 16, 18, 20, etc. gage steel or other metal or material. Although the size of the stud 220 and the material from which it is formed may vary depending upon the application and loading conditions, in one embodiment for example, the web 222 may be made in various widths of, for example, 3⅝ inches, 6 inches and eight inches (distance "A"). The first and second flanges (224, 226) may be fabricated with a variety of different heights ranging from, for example, 2 inches-3.5 inches (distance "B"). The widths of the first and second legs (228, 230) of a stud that has a web width of 3⅝ inches may be 1 1/16 inches (distance "C"). Thus in this embodiment, the distance between the ends of the first and second legs (228, 230) is 1½ inches (distance "D"). The widths of the first and second legs (228, 230) of a stud that has a web width of six inches would be, for example, 2¼ inches. The widths of the first and second legs (228, 230) of a stud that has a web width of eight inches would be, for example, 3¼ inches. In various embodiments, the length of each return portion (232, 234) may be ¾ inches (distance "E"). It will be appreciated, however, that other sizes of stud 220 could be used depending upon the specific application.

In the embodiment depicted in FIGS. 9 and 11, a header stud 220 is used to form the header assembly 219 and studs 220' are used to form the jamb studs which form the vertical boundaries of the opening 201. Studs 220' are identical to studs 220 and are identified herein with the "'" symbol to distinguish between the use of a stud 220 as a header and as a jamb stud. For example, each jamb stud 220' has a substantially planar jamb stud web 222', a first jamb stud flange 224' and a second jamb stud flange 226' that protrude from the jamb stud web 222'. A first jamb stud leg 228' is attached or otherwise formed on the first jamb stud flange 224' and a second jamb stud leg 230' is formed on or attached to the second jamb stud flange 226'. A first jamb stud return 232' is formed on the end of the first jamb stud leg 228' and a second jamb stud return 234' is formed on the end of the second jamb stud leg 230'. See FIG. 11. In this embodiment, the stud 220 is interposed between the jamb studs 220 and may be quickly coupled to the jamb studs 220' by connector clips 240.

Figure 13:
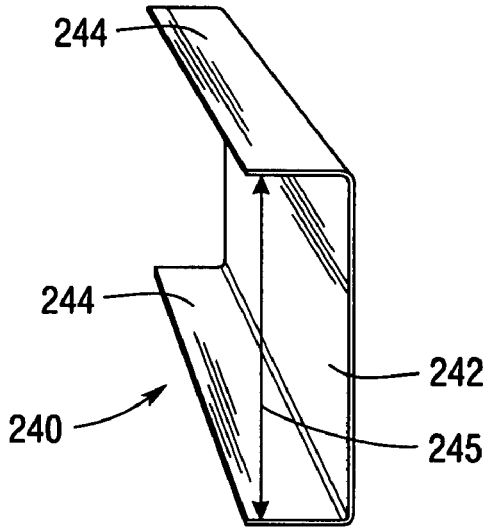
FIG. 13 is a perspective view of one embodiment of an attachment clip of the present invention.

As can be seen in FIG. 13, in this embodiment, on connector clip embodiment has a clip web 242 and a pair of clip flanges 244 protruding from the clip web 242. The clip flanges 244 define a header-receiving space 245 therebetween. The clip web 242 of the clip 240 is fastened to the jamb stud web 222' of the corresponding jamb stud 220' by appropriately sized fasteners such as sheet metal screws or the like and one end of the header stud 220 is inserted between the clip flanges 242 as shown in FIG. 11. Each end of the header stud 220 is attached to the clip 240 utilizing threaded fasteners 246 such as sheet metal screws or the like. However, header stud 220 could be welded to the clip 240.

Figure 11A:
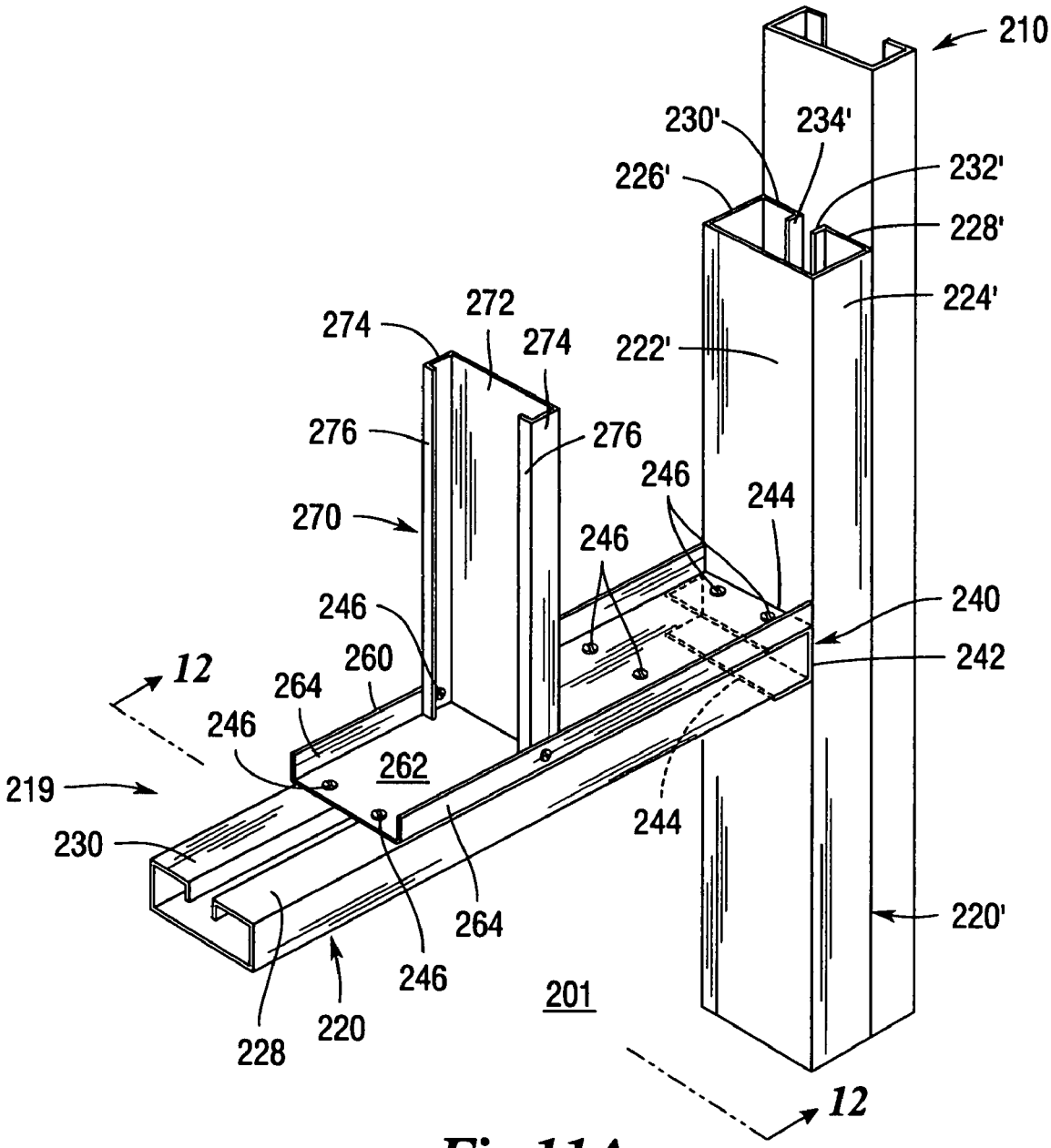

As shown in FIG. 11, in this embodiment, a header track 260 is supported on and attached to the first and second legs (228, 230) of the header stud 220. Header track 260 has a header track web 262 and a pair of upstanding header track flanges 264. The web 262 of the header track 260 is attached to the first and second header legs (228, 230) of the header stud 220 by fasteners 246 which may comprise conventional sheet metal screws or the like. In addition, pieces of studs 270, which may be conventional in nature, may be attached to the track header 260 and the upper track 206. Studs 270 may each have a web 272, pair of flanges 274 and a return 276 formed on the end of each flange 274. The flanges 274 of the studs 270 are attached to the header flanges 264 and the upper track flanges 208 by fasteners such as sheet metal screws or the like. Studs 270 serve as the cripple studs for the header arrangement. For window or door openings that require additional support due to their width, an additional conventional stud 210 could be attached to the jamb stud 220' as shown in FIG. 11A.

Figure 14:
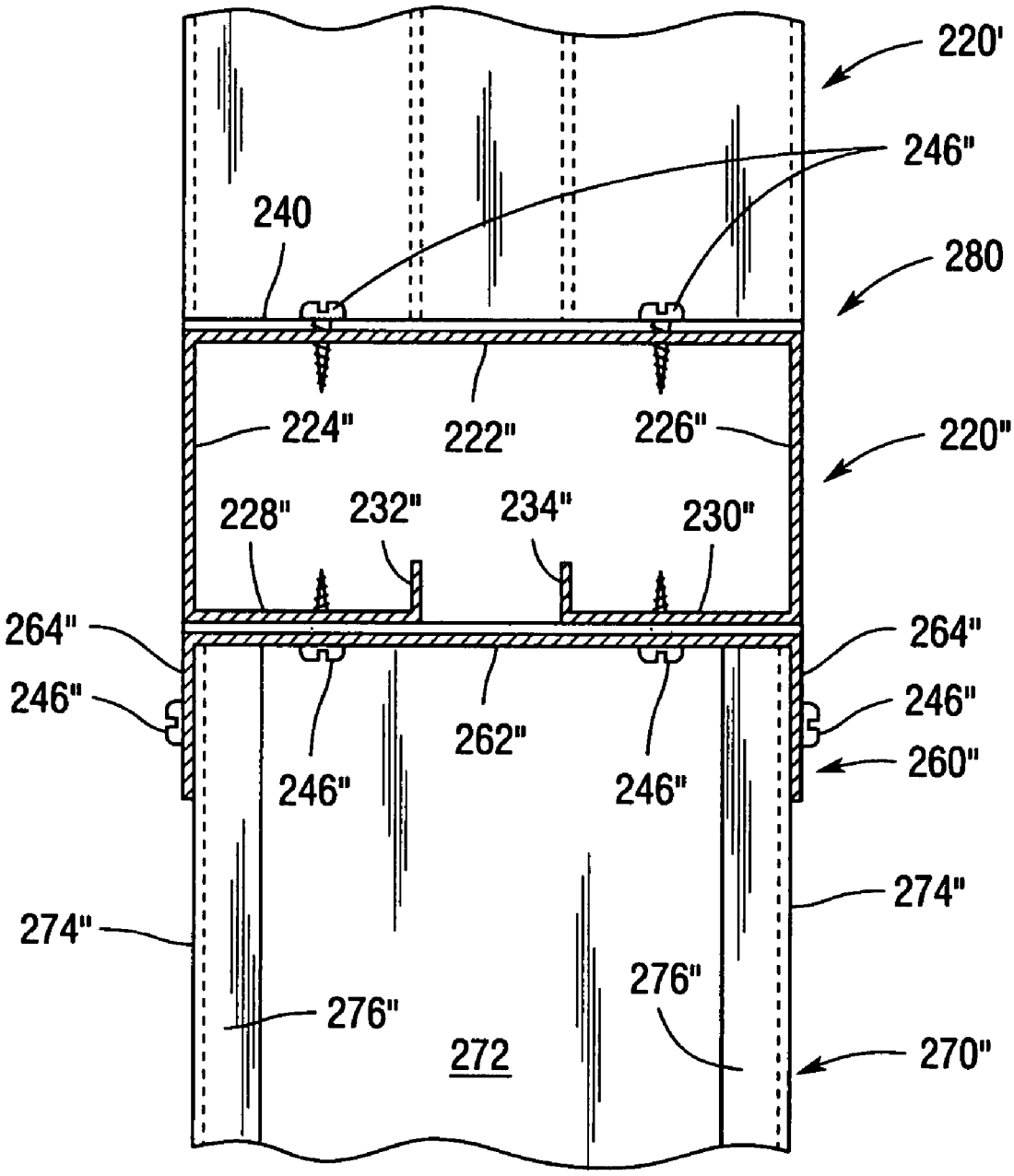
FIG. 14 is a partial cross-sectional view of the sill and jamb stud embodiment of FIG. 9 taken along line 14-14 in FIG. 9.

As can also be seen in FIGS. 9 and 14, sill studs 220" may be used to form a windowsill designated as 280. Sill studs 220" are identical to header studs 220 and are identified herein with the " symbol to distinguish between the use of a stud 220 as a header and as a sill stud. For example, each sill stud 220" has a substantially planar sill stud web 222", a first sill stud flange 224" and a second sill stud flange 226" that protrude from the sill stud web 222". See FIG. 14. A first sill stud leg 228" is attached or otherwise formed on the first sill stud flange 224" and a second sill stud leg 230" is formed on or attached to the second sill stud flange 226". A first sill stud return 232" is formed on the end of the first sill stud leg 228" and a second sill stud return 234" is formed on the end of the second sill stud leg 230".

In this embodiment, the sill stud 220" is oriented with the flanges 224" and 226" extending toward the lower track 202 and is coupled to the jamb studs 220' by connector clips 240 in the manner described above. Also in this embodiment, a sill track 260" is supported on and attached to the first and second legs (228", 230") of the sill stud 220". Sill track 260" has a sill track web 262" and a pair of upstanding sill track flanges 264". The sill track web 262" of the sill track 260" is attached to the first and second sill track legs (228", 230") of the sill stud 220" by fasteners 246" which may comprise conventional sheet metal screws or the like. In addition, pieces of studs 270", which may be conventional in nature, may be attached to the sill track 260" and the lower track 202. Studs 270" may each have a web 272", pair of flanges 274" and a return 276" formed on the end of each flange 274". The flanges 274" of the studs 270" are attached to the sill track flanges 264" and the lower track flanges 208 by fasteners 246" such as sheet metal screws or the like. Studs 270" serve as the cripple studs for the sill 280.

Such header, jamb stud and sill arrangements of the present invention require less labor and material to assemble than the prior header configurations. It will also be appreciated, however, that the uniquely shaped studs 220, 220', 220" could be used in a variety of other applications and combinations. For example, the header studs 220 and the sill studs 220" could be used to form headers and sills, respectively as described above in connection with conventional jamb stud arrangements. Likewise, the studs 220' could be used to form jamb studs that are used in connection with conventional header and sill assemblies. Thus, it will be appreciated that the header studs 220 and/or sill studs 220" do not have to be used in connection with jamb studs 220' if use of other jambs stud arrangements is more preferable and visa-versa. It will be also appreciated that the studs (220, 220', 220") could be used in connection with wood studs and wood framing assemblies.

Figure 15:
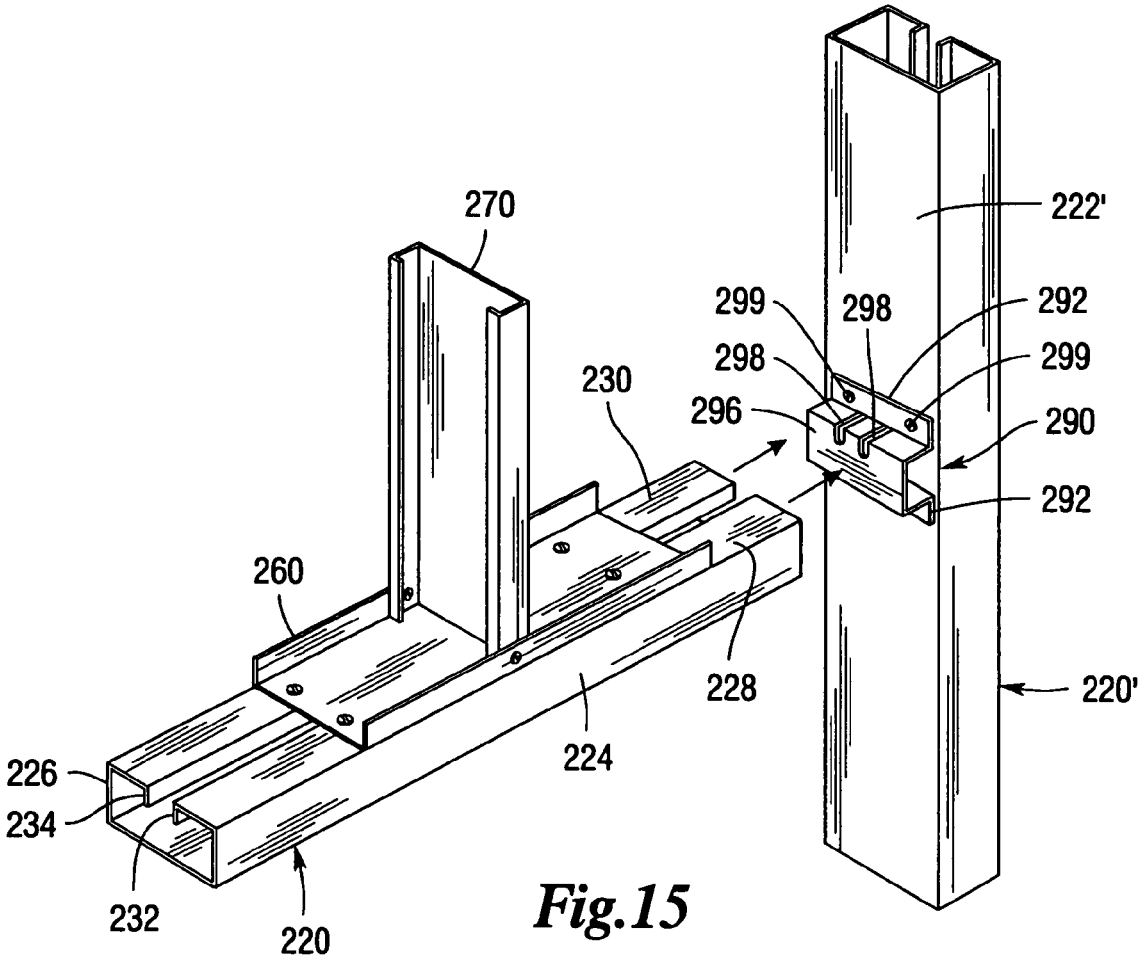
FIG. 15 is a partial perspective view of another header and jamb stud embodiment of the present invention.
Figure 16:
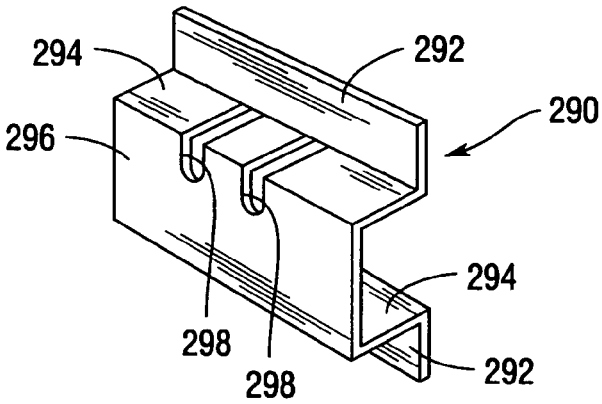
FIG. 16 is a perspective view of another attachment clip of the present invention.

In another header assembly embodiment of the present invention, a connector clip 290 of the type illustrated in FIGS. 15 and 16 is employed. As can be seen in FIG. 16, the connector clip 290 has a pair of clip attachment tabs 292 and a raised central portion 296. The clip attachment tabs 292 are substantially coplanar with each other. The central portion 296 is substantially parallel to the clip attachment tabs 292 and is attached thereto by a pair of clip legs 294. The clip attachment tabs 292 are attached to the jamb stud web 222' of the jamb stud 220' by fasteners 299 such as sheet metal screws and the end of the header stud 220 is inserted over the central portion 296 such that the central portion 296 is received in the area between the first and second header flanges (224, 226) and the first and header second legs (228, 230). As can be seen in FIGS. 15 and 16, a pair of return-receiving slots 298 are provided in a portion of the central portion 296 and one of the clip legs 294 for receiving the first and second header returns (232, 234) when the ends of the header stud 220 is inserted over the raised central portion 286. The header stud 220 is then attached to the connector clip 290 by conventional fasteners such as such metal screws or the like. The header stud 220 could also be attached to the connector by welding or other fastener arrangements. Such connector clip arrangement may provide further torsional stability to the header stud 220 when installed in this manner. Connector 290 could also be used to attach the sill studs 220" to the jamb studs 220' in the above-described manners.

Figure 17:
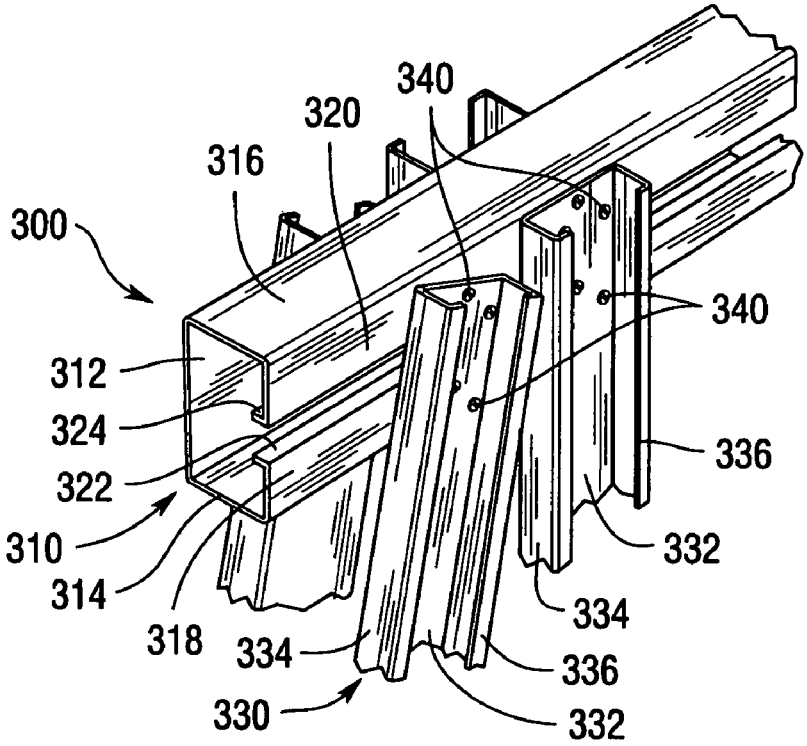
FIG. 17 is a perspective view of a portion of a truss chord embodiment of the present invention.

FIG. 17 illustrates a unique and novel truss chord arrangement 300 of one embodiment of the present invention. In this embodiment, a chord stud 310, which is essentially identical in construction as the header stud 220, is employed to form the truss chord. The chord stud 310 has a substantially planar chord web 312 and a first chord flange 314 and a second chord flange 316 protruding therefrom. A first chord leg 318 protrudes from the first chord flange 314 and a second chord leg 320 protrudes from the second chord flange 316. A first chord return 322 is formed on the end of the first chord leg 318 and a second chord return 324 is formed on the end of the second chord leg 320. Pieces of studs 330 which are conventional in nature are attached to the first and second chord legs (314, 316) and the chord web 312 of the chord stud 310 utilizing fasteners 340 such as sheet metal screws. The studs 330 each have a web 332, a pair of flanges 334 and a lip 336 formed on the end of each flange 334. These studs 330 form the webs of the truss. Such arrangement eliminates labor required to weld two pieces of stud together to form the truss chord.

Figure 18:
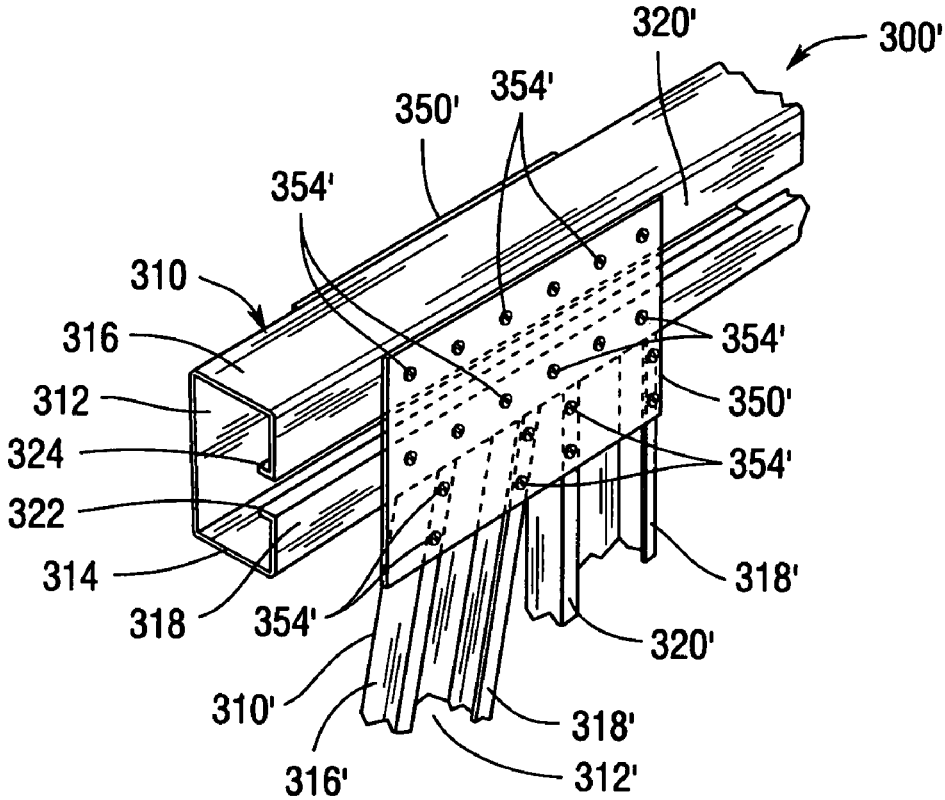
FIG. 18 is a perspective view of a portion of a truss embodiment of the present invention.

FIG. 18 illustrates another truss assembly 300' of the present invention. In this embodiment, the truss webs are formed from truss studs 310' which are each essentially identical in construction as the chord stud 310. Each truss stud 310' has a substantially planar chord web 312' and a first chord flange 314' and a second chord flange 316' protruding therefrom. A first chord leg 318' protrudes from the first chord flange 314' and a second chord leg 320' protrudes from the second chord flange 316'. A first chord return 322' is formed on the end of the first chord leg 318' and a second chord return 324' is formed on the end of the second chord leg 320'. In this embodiment, the truss studs 310" are attached to the chord stud 310 by one or more gusset plates 350' and fasteners 354' such as sheet metal screws. The gusset plates 350' may be fabricated from steel or other suitable material.

Figure 19:
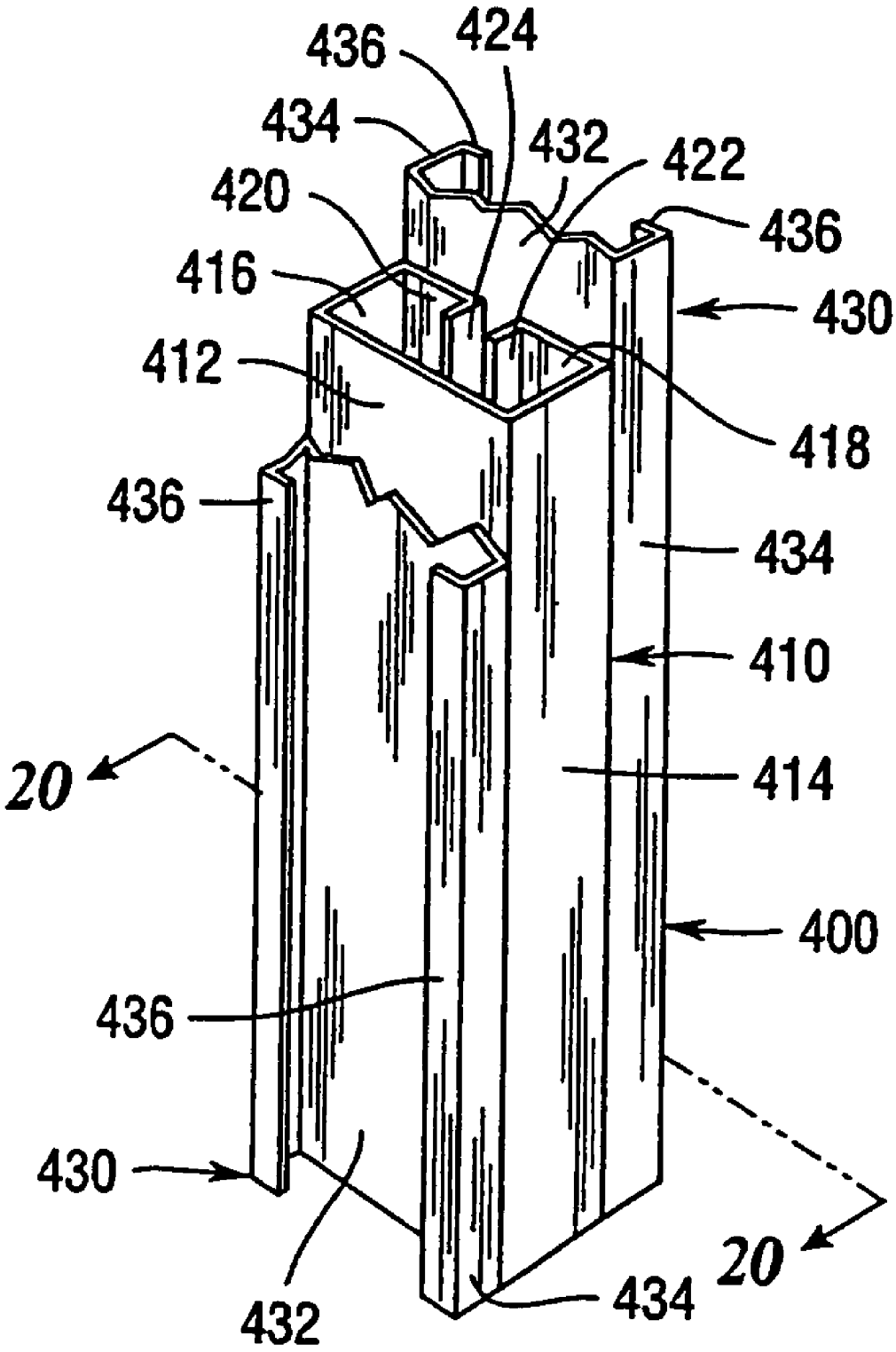
FIG. 19 is a perspective view of a portion of a support post of the present invention.
Figure 20:
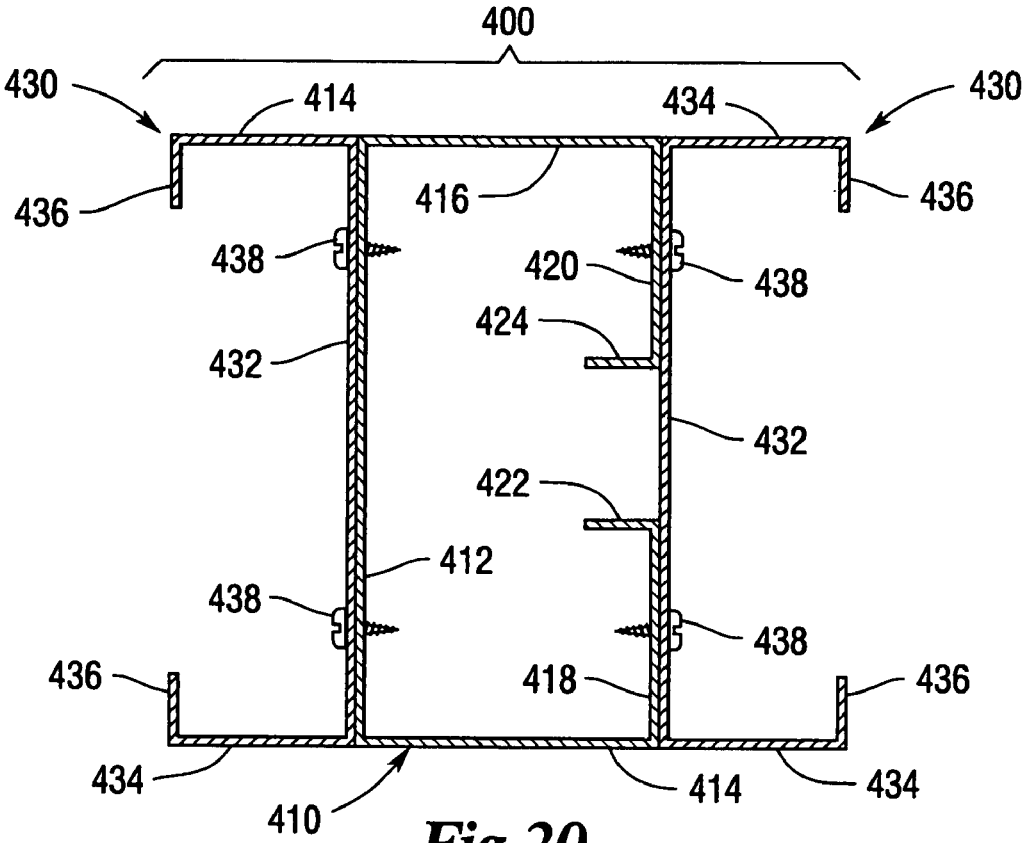
FIG. 20 is a portion of a cross-sectional view of the support post embodiment of FIG. 19 taken along line 20-20 in FIG. 19.

FIGS. 19 and 20 illustrate a support post 400 embodiment of the present invention that is formed utilizing a post stud 410 which is identical to the header stud 220 described above. The post stud 410 has a substantially planar post stud web 412 and a first post stud flange 414 and a second post stud flange 416 protruding from the post stud web 412. A first post stud leg 418 protrudes from the first post stud flange 414 and a second post stud leg 420 protrudes from the second post stud flange 416. A first post stud return 422 is formed on the end of the first post stud leg 418 and a second post stud return 424 is formed on the end of the second post stud leg 420. See FIG. 19.

In this embodiment, the post stud 410 is used in connection with two studs 430. The studs 430 each have a web 432 and two flanges 434. A lip 436 is formed on the end of each flange 434. The post 400 is formed by attaching the web 432 of one of the studs 430 to the post stud web 412 of the post stud 410 with fasteners 438 such as sheet metal screws or the like and the web 432 of the other stud 430 is attached to the first and second post stud legs (418, 420) of the post stud 410 by sheet metal screws 438 or the like. I have discovered that such arrangement provides an equivalent amount of structural support as prior post arrangements that employ three conventional studs and two pieces of conventional track. Thus, this embodiment of the present invention reduces the amount of material needed and also the amount of labor needed to assemble it when compared to prior post assemblies. It will be appreciated, however, that the post stud 410 may also be used in connection with one stud 430 or more than two studs 430 without departing from the spirit and scope of the present invention.

Figure 21:
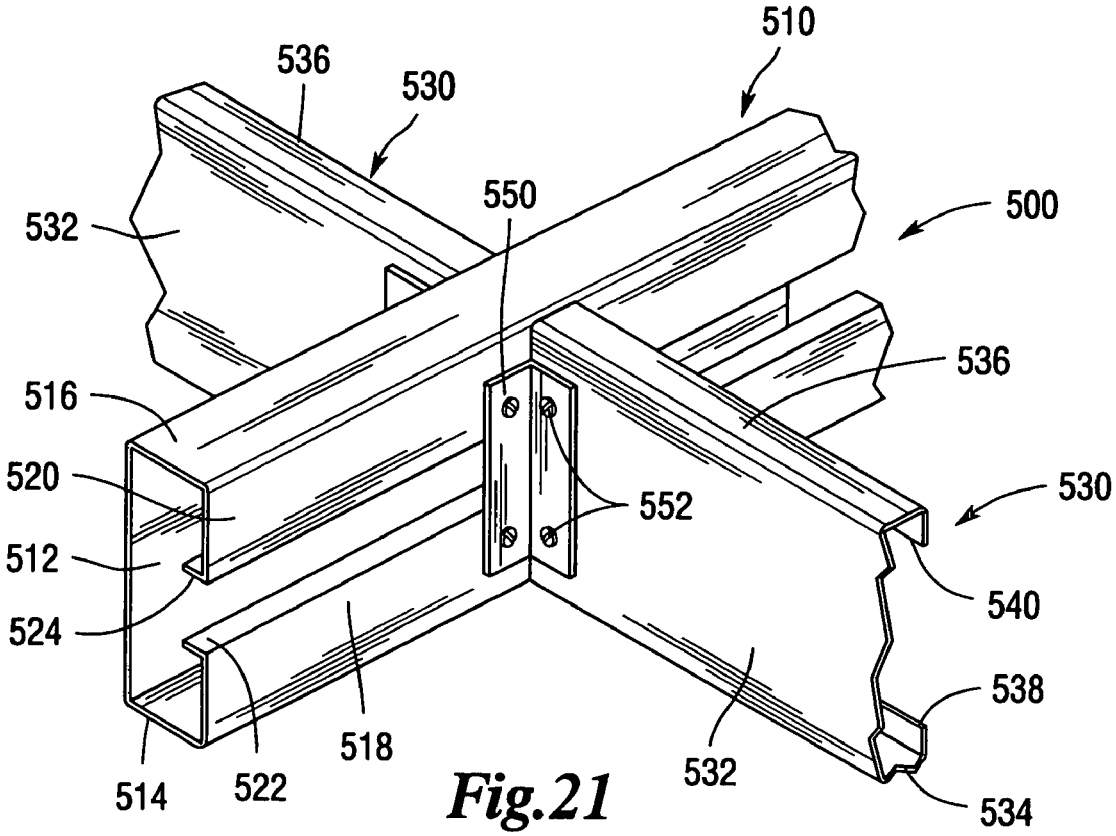
FIG. 21 is a perspective view of a portion of a floor girder embodiment of the present invention.

The unique and novel studs of the present invention may also be used as a floor girder 502 in a floor system 500. More particularly and with reference to FIG. 21, a single girder stud 510 serves as a floor girder for attaching conventional floor joists 530 thereto. The girder stud 510 is identical in construction when compared to the header stud 220 described above. In one embodiment, the girder stud 510 has a substantially planar girder web 512 and a first girder flange 514 and a second girder flange 516 protruding from the girder web 512. A first girder leg 518 protrudes from the first girder flange 514 and a second girder leg 520 protrudes from the second girder flange 516. A first girder return 522 is formed on the end of the first girder leg 518 and a second girder return 524 is formed on the end of the second girder leg 520.

The floor joists 530 may have a joist web 532 and a first joist flange 534 and a second joist flange 536. A first joist lip 538 is formed on the end of the first joist flange 534 and a second joist lip 540 is formed on the end of the second joist flange 536. One series of joists 530 are attached to the first and second girder legs (518, 520) of the girder stud 510 by conventional L-shaped clips 550 and sheet metal screws 552 or the like. The joists 530 protruding from the other side of the girder stud 510 are attached to the girder web 512 of the girder stud 510 by L-shaped clips 550 and fasteners 552. Such improved arrangement eliminates the need to assemble the girder from a conventional stud and track and the labor associated with making such girder. It will be further appreciated that the girder of the present invention may find utility in non-floor applications without departing form the spirit and scope of the present invention.

Figure 22:
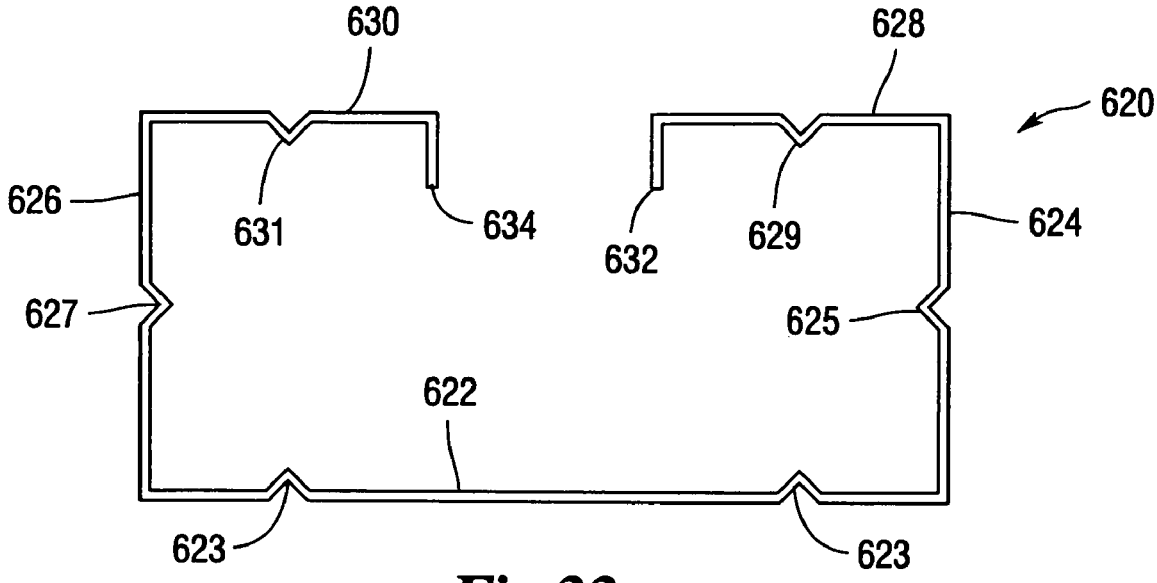
FIG. 22 is an end view of another stud embodiment of the present invention.
Figure 23:
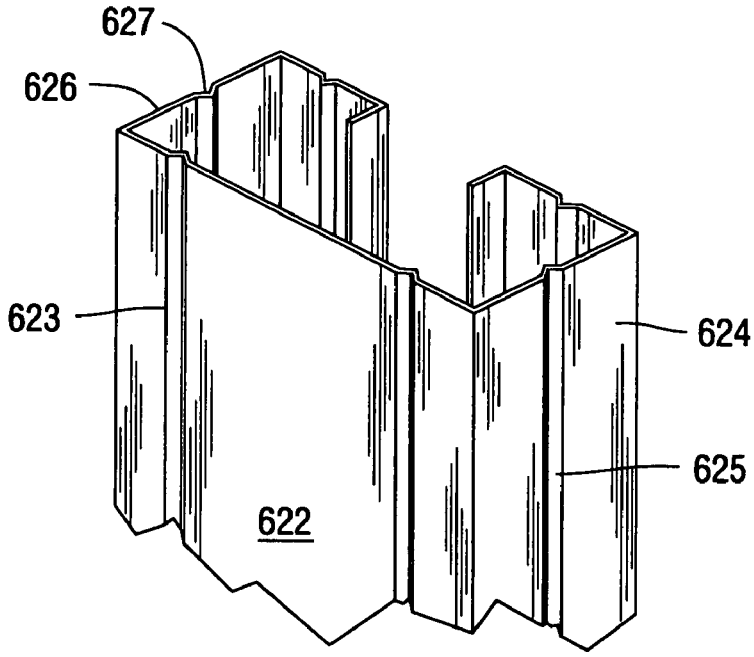
FIG. 23 is a perspective view of a portion of the stud of FIG. 22.

FIGS. 22 and 23 illustrate an alternative stud embodiment 620 of the present invention. Stud 620 includes a web 622, a first flange 624 and a second flange 626. The first and second flanges (624, 626) protrude outwardly from the web 622. A first leg 628 protrudes from the first flange 624 such that the first leg 628 is substantially parallel to the web 622. Likewise, a second leg 630 protrudes from the second flange 626 such that it is substantially parallel to the web 622. A first return 632 protrudes from the first leg 628 and a second return 634 protrudes from the second leg 630. See FIG. 22.

In one embodiment, the stud 620 is rollformed from steel sheet by utilizing conventional rollforming methods and equipment. For example, the stud 620 may be fabricated from 12, 14, 16, 18, 20, etc. gage steel or other metal or material. In this embodiment, the stud 620 may further include a series of stiffener ribs. More particularly and with reference to FIG. 22, the web 622 may have one or more web stiffener ribs 623 therein. Web stiffener ribs 623 may continuously extend the entire length of the web 622 or they may, for example, be provided in an intermittent manner along the web 622. Similarly, flange stiffener ribs may be provided in the flanges 624 and/or 626. For example, at least one first flange stiffener rib 625 may be provided in the first flange 624. The first flange stiffener rib 625 may continuously extend the entire length of the first flange 624 or it may be intermittently provided therein. At least one second flange stiffener rib 627 may be provided in the second flange 626. The second flange stiffener rib 627 may extend the entire length of the second flange 626 or it may be intermittently provided therein. In addition, at least one first leg stiffener rib 629 may be provided in the first leg 628. The first leg stiffener rib 629 may continuously extend the entire length of the first leg 628 or it may be intermittently provided therein. At least one second leg stiffener rib 631 may be provided in the second leg 630. The second leg stiffener rib 631 may extend the entire length of the second leg 630 or it may be intermittently provided therein. Various stud embodiments may include one or more web stiffener ribs, flange stiffener ribs and leg stiffener ribs or any combination thereof depending upon the specific application. For example, one embodiment may only include at least one stiffener rib in the web of the stud. Another embodiment may only include at leas one stiffener rib in each flange. Another embodiment may include at least one stiffener rib in each of the legs. Still another embodiment may include at least one stiffener rib in the flanges, but not in the web. Another embodiment may include at least one stiffener rib in each leg, but nowhere else in the stud. Another embodiment may include at least one stiffener rib in each leg and at least one stiffener rib in the web, but not in the flanges. The present disclosure is meant to encompass all permutations and combinations of stiffener ribs without departing from the spirit and scope of the present invention.

Figure 24:
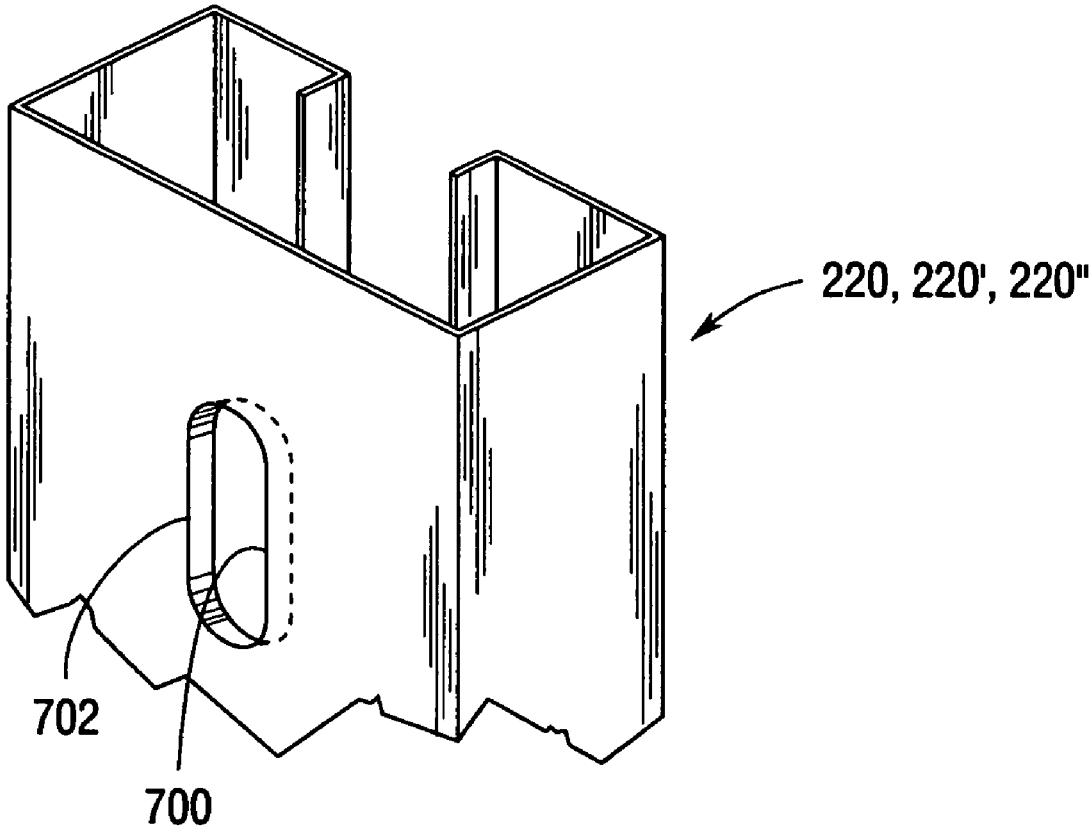
FIG. 24 is a perspective view of a portion of other stud embodiments of the present invention.

In yet another embodiment, one or more access holes 700 may be provided through the webs of studs 220, 220', 220", 620 disclosed herein. See FIG. 24. The access holes may be formed in the webs of the respective studs such that a perimeter flange 702 extends around the perimeter of the hole 700. Studs containing such holes could be used in any of the above-described embodiments to form, for example, headers, sills, jamb studs, truss chords, posts, and girders.

As can be appreciated from the foregoing description, the unique and novel stud configurations of the present invention may have a variety of advantages over prior component configurations. In particular, when used in window and door framing applications, the novel stud arrangements of the present invention eliminate the buildup activities associated with prior methods. The invention which is intended to be protected is not to be construed as limited to the particular embodiments disclosed. The embodiments are therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A header assembly comprising:

a first vertically extending jamb stud;

a second vertically extending jamb stud supported in spaced apart relationship with respect to said first vertically extending jamb stud;

a first connector attached to said first vertically extending jamb stud, said first connector having a raised first central portion with first return-receiving grooves therein;

a second connector attached to said second vertically extending jamb stud and having a raised second central portion with second return-receiving grooves therein; and a rollformed header comprising:

a substantially planar header web;

a first header flange protruding from said substantially planar header web;

a second header flange protruding from said substantially planar header web and being spaced from said first header flange;

a first header leg protruding from said first header flange and being substantially parallel to said substantially planar header web;

a second header leg protruding from said second header flange and being substantially parallel to said substantially planar header web and substantially coplanar with said first header leg to define support surfaces spanning between said first and second vertically extending jamb studs, said first header web and said first and second header flanges and legs defining a hollow area within said header;

a first header return on an end of said first header leg; and a second header return on an end of said second header leg and wherein said header being supported between said first and second jamb studs such that said first raised central portion of said first connector is received in said hollow area within one end of said header such that said first and second header returns are received in said first return-receiving grooves in said first raised central portion and wherein said second raised central portion of said second connector is received in said hollow area adjacent another end of said header such that said first and second returns are received in said second return-receiving grooves in said second raised central portion.

2. The header assembly of claim 1 further comprising an upper track supported on said first and second header legs.

3. The header assembly of claim 1 wherein said header is formed from cold formed metal.

4. The header assembly of claim 1 wherein at least one of said first and second jamb studs comprises:

a substantially planar jamb stud web;

a first jamb stud flange protruding from said substantially planar jamb stud web;

a second jamb stud flange protruding from said substantially planar jamb stud web and being spaced from said first jam stud flange;

a first jamb stud leg protruding from said first jamb stud flange and being substantially parallel to said substantially planar jamb stud web;

a second jamb stud leg protruding from said second jamb stud flange and being substantially parallel to said substantially planar jamb stud web;

a first jamb stud return on an end of said first jamb stud leg; and a second jamb stud return on an end of said second jamb stud leg.

* * * * *